US009145284B2

(12) United States Patent
Finkbeiner et al.

(10) Patent No.: US 9,145,284 B2
(45) Date of Patent: Sep. 29, 2015

(54) METHOD FOR PRODUCING A TRACK AND TRACK FOR A TRACK LIFTING DEVICE

(75) Inventors: Gerhard Finkbeiner, Freudenstadt (DE); Dieter Benz, Alpirsbach (DE)

(73) Assignee: Gerhard Finkbeiner, Freudenstadt (DE)

( * ) Notice: Subject to any disclaimer, the term of this patent is extended or adjusted under 35 U.S.C. 154(b) by 610 days.

(21) Appl. No.: 13/574,279

(22) PCT Filed: Jan. 18, 2011

(86) PCT No.: PCT/EP2011/050566

§ 371 (c)(1),
(2), (4) Date: Jul. 20, 2012

(87) PCT Pub. No.: WO2011/092078

PCT Pub. Date: Aug. 4, 2011

(65) Prior Publication Data

US 2012/0298941 A1 Nov. 29, 2012

(30) Foreign Application Priority Data

Feb. 1, 2010 (DE) ..... 10 2010 006 552

(51) Int. Cl.

| | |
|---|---|
| ***B66F 3/22*** | (2006.01) |
| ***B66F 3/24*** | (2006.01) |
| ***B66F 7/06*** | (2006.01) |
| ***B66F 7/28*** | (2006.01) |

(52) U.S. Cl.
CPC ..... *B66F 7/0691* (2013.01); *B66F 7/28* (2013.01)

(58) Field of Classification Search
CPC ..... B66F 7/22; B66F 7/28; B66F 7/0691
USPC ..... 254/93 R, 133 R, 122, 10 R, 10 B, 10 C; 269/289 R; 72/379.2, 324; 414/639, 414/590
See application file for complete search history.

(56) References Cited

U.S. PATENT DOCUMENTS 3,220,698 A * 11/1965 Carder ..... 254/2 B
5,419,534 A * 5/1995 Vesely ..... 254/9 C

FOREIGN PATENT DOCUMENTS

| | | |
|---|---|---|
| DE | 24 40 449 | 3/1976 |
| DE | 91 04 973 | 6/1991 |
| DE | 102 13 308 | 10/2003 |
| DE | 10 2007 010804 | 9/2008 |

OTHER PUBLICATIONS

International Search Report for corresponding patent application No. PCT/EP2011/050566 dated Apr. 21, 2011.

* cited by examiner

*Primary Examiner* — Lee D Wilson
*Assistant Examiner* — Seahee Yoon
(74) *Attorney, Agent, or Firm* — Renner, Otto, Boisselle & Sklar, LLP

(57) ABSTRACT

The invention relates to a method for producing a track (14) for a track lifting device (11) and to a track (14) which can be transferred from an idle position into a working position (12) by at least one lifting unit (15), wherein a main body (27) of the track (14) is made from a plate-shaped material, wherein the main body (27) is transferred by a plurality of chamfering steps of the plate-shaped material into an end shape in which, between a load pick-up (16) and a respective side flange (31) adjoining same laterally, a chamfer (28, 29) is formed having a chamfer direction of the chamfers directed toward each other, and each side flange (31) formed in this way is delimited by at least one further chamfer (32, 33) having a chamfer direction opposite to the chamfer direction of the chamfers (28, 29). A receiving web (34) is formed with a travel surface (36) directed toward the running surface (17) of the load pick-up (16).

14 Claims, 7 Drawing Sheets

METHOD FOR PRODUCING A TRACK AND TRACK FOR A TRACK LIFTING DEVICE

The invention relates to a method for producing a track and to a track for a track lifting device, said track being transferrable by at least one lifting unit from an idle position to a working position.

Such a generic lifting device for vehicles, assembly units, machines or the like is known from DE 102 13 308 A1. This lifting device comprises a track, with which two lifting units engage, for example, and lift the track from an idle position into a working position so that, for example, repairs and servicing works can be carried out on a vehicle. In the idle position, the track lies on the floor for example or is arranged at ground level in a cavity in the floor so that, in particular, a vehicle can drive onto the track.

The track comprises a load-bearing support, which for example has a flat running surface. Outwardly open C-shaped profiles are arranged adjacent to the load-bearing support. On the one hand, these C-shaped profiles support the load-bearing support, and on the other hand a travel surface for a jack, which is received displaceably between two running rails arranged adjacent to one another, is formed at the lower portion of the C-shaped profile protruding freely outwardly. A C-profile for bracing may also be provided on the inner face of said above-mentioned C-profile. These C-profiles are additionally distanced from one another by transverse plates, which also engage with the underside of the load-bearing support at the same time. In addition, stiffening ribs are provided, which engage with the underside of the load-bearing support and also with the transverse stiffening element.

The above-described components, which form the track, are each interconnected by welded connections so that this track is constructed as a welded structure. Such tracks enable individual construction in a simple manner. However, the production of such tracks is time-consuming. In addition, welded structures pose the fundamental risk that they may buckle during production and have to be re-aligned.

The object of the invention therefore is to propose a method for producing a track and a track for a track lifting platform, said track being cost-effective, highly rigid and still enabling lightweight construction.

This object is achieved in accordance with the invention by a method for producing a track for a track lifting device, in which a main body of the track or the cross-sectional profile of the track, consisting of a load-bearing support, side flanks, and receiving flanges made of a plate-like material, is transferred into an end shape by a plurality of chamfering steps. At least one chamfer is provided between the load-bearing support and each side flank adjoining said load-bearing support laterally, and, opposite this chamfer, each side flank is defined by at least one further chamfer, and a receiving flange having a travel surface oriented towards the load-bearing support is formed.

This method makes it possible for the main body of the track to consist of a common plate-like material and, due to the opposed chamfers between the running rail and the side wall as well as between the side wall and the receiving flange, for the individual portions of the track, such as the load-bearing support, side flanks and receiving flanges, to be interconnected continuously. The force flow lines can thus extend in an uninterrupted manner along the entire cross-section of the track, whereby a high level of rigidity is achieved. A high high level of bracing with respect to deflection of the track when a load is received can be provided by the continuous connection via at least one chamfer between the side flanks and the load-bearing support on the one hand and between the side flanks and the receiving flanges on the other hand as well as the opposed chamfer directions. In particular, the receiving flanges counteract the deflection as tension flanges.

In accordance with a preferred embodiment of the method, the main body of the track is chamfered starting from a flat, plate-like material (a metal sheet). Sheet metals or metal sheets having a sheet thickness of 3, 4, 6, 8 or 10 mm for example are preferably used and are chamfered. In particular, these metal sheets may have a length of at least 3 m and are preferably adapted in length to the overall length of the track, for example 8, 10 or 14 m. The chamfer can thus be made over the entire length of the plate-like material or over the entire length of the track, or can be welded together from smaller individual parts.

In an alternative embodiment of the method, the main body is produced from a rolled cold profile. The desired profile shape can be achieved in a plurality of rolling steps. This also enables the precise introduction of recesses before the forming process. Alternatively, the main body may be chamfered from a pre-profiled, plate-like material, in particular from a plate-like material having a U-shaped profile. For example, U-shaped profiles may be provided of which the base area between the two branches corresponds to the desired width of the running surface of the load-bearing support so that at least one chamfer is still necessary, at least at each branch of the U-shaped profile or at each side flank, to form the receiving flange. The production of the main body of the track can thus be simplified further.

In a preferred embodiment of the method, the main body is chamfered, at least four times, from a flat plate-like material formed as a metal sheet. The side flanks are thus angled in relation to the load-bearing support, and the receiving flanges are also angled in relation to the side flanks, and therefore the main body is preferably formed in the manner of a clamp or the like. All angles of chamfer are preferably of equal size. A relatively short set-up time is thus required at the chamfering press.

In accordance with a further preferred embodiment of the method, the side flanks are chamfered at an angle to the load-bearing support of 60° to 90°, as are the receiving flanges to the adjoining side flanks. A cross-sectional geometry can thus be achieved which approximates that of the previous welded structures. An angle of chamfer between 70° and 80° is preferably provided. With this angle of chamfer, the main body has an omega-like contour from one end face, wherein the load-bearing support and the side flanks are each formed in a straight line between the radii of bend of the chamfers.

Furthermore, the main body of the track profiled from a plurality of chamfering steps is produced in such a way that the second or last chamfer, which, together with a first or at least one further chamfer, determines the width of the track, constitutes a last chamfering step for production of the profiled main body. The width of the track can be produced precisely as a result of this procedure. For example, if a flat running surface of the track is formed, wherein the chamfers adjoin the flat running surface directly, these two chamfers can be made as the last two processing steps. A chamfer adjoining the running surface of the track can also be produced before of after further chamfers, wherein the second chamfer for determining the width of the running surface of the track is again made as the last chamfering step. It is thus possible to increase accuracy when producing such tracks.

In a further preferred embodiment of the invention, at least fixing bores, recesses or assembly openings are introduced by cutting jet machining, in particular by laser cutting jet machining, either before or during the chamfering steps. Due to the fact that the cross-sectional geometry of the main body for the track is formed from a plate-like material, the individual fixing bores, recesses or assembly openings can be machined precisely in relation to one another. For example, the plate-like material can be machined in a simple and precise manner in conventional machining systems, in particular laser cutting systems, before the chamfers are made. In addition, manual reworking once the track has been produced, as was previously required in the case of welded structures, is no longer necessary. A further time and cost reduction when producing the track as well as an increase in accuracy can thus be achieved.

The object of the present invention is further achieved by a track in which the load-bearing support, the side flanks and receiving flanges are produced in one piece with the running surfaces thereof from a main body in the form of a chamfered profile formed from a plate-like material. This embodiment affords the advantage that it is not necessary to join individually the load-bearing support, the side flanks and the receiving flanges, as is the case with the welded structures according to the prior art. In addition, a continuous connection and a transition between the individual portions of the main body of the track can be provided by the bends arranged between the load-bearing support and the side flanks as well as between the side flanks and the receiving flanges, whereby an increase in the flexural rigidity of the track profile in particular is enabled. This track can be produced in particular by chamfering the plate-like material and affords the advantage that the main body can be formed and shaped using only one type of machine.

In a preferred embodiment of the invention, outer ends of the outwardly pointing receiving flanges are distanced once the chamfers have been made, said distance corresponding to or being less than the width of the running surface. A maximum width of the running surface is thus obtained with predefined available space, and the arrangement of a jack between the two running surfaces whilst maintaining the optimised force flow lines is also enabled due to the chamfers in the plate-like material.

In a preferred embodiment of the track, an angle of 90° or less, in particular of 70° to 80°, is provided between the load-bearing support and the side flanks. The respective chamfer can be provided or an angle of chamfer can be selected depending on whether the track is installed in a cavity and/or depending on the required running surface width of the load-bearing support. For example, if it is not necessary to restrict the width of the track, angles of chamfer of 90° can be used. If the widest possible running surface of the load-bearing support is provided at a predefined width to the arrangement of the tracks, angles between 70° and 80° are preferably provided so that the free end of the running surface at the receiving flange does not protrude beyond this region of transition or the chamfer between the side flanks and the load-bearing support.

In a further preferred embodiment of the invention, an angle of 90° or less is provided between the side face and the receiving flange, wherein the receiving flange is oriented towards the respective outer face of the track. This angle of chamfer is dependent on the angle of chamfer between the side flanks and the running surface and is selected in such a way that the running surface is preferably aligned parallel to the running surface of the load-bearing support.

In a further preferred embodiment of the track, at least one longitudinal stiffening element, in particular a profiled longitudinal beam, is provided on an underside of the load-bearing support. This longitudinal stiffening element takes up the surface load of the travel surface or running surface, whereby a buckling of the travel surface or running surface and a deflection of the track is counteracted. I-shaped or trapezoid longitudinal beams may preferably be used. In particular, trapezoid longitudinal beams afford the advantage that a high stiffening effect can be achieved at low weight. Such a longitudinal beam is preferably oriented centrally to the longitudinal axis of the load-bearing support.

Furthermore, one or more transverse stiffening elements are preferably provided inside the track, engage with the side flanks and an underside of the load-bearing support, and support the longitudinal beams. The load taken up can thus be dissipated outwardly into the main body. These transverse stiffening elements are integrated in the main body via a plug-in or welded construction. The side walls and the receiving flanges can thus be prevented from buckling outwardly when a load is taken up, and at the same time the rigidity of the main body for the track can be increased.

The track preferably receives a cover element at an underside of the two receiving flanges, said cover element extending in the longitudinal direction of the track, at least over portions, and preferably being flat or profiled by at least one chamfer. These cover elements or cover sheet metals extend at least into the free regions beyond the working regions of the lifting units. A closed box-like profile can be created by these cover elements, which are preferably fastened to the underside of the receiving flanges via a welded connection, so as to again increase the rigidity of the track. Due to the chamfer preferably made in the cover element, the cover element itself may be stiffened and, at the same time, the periphery of the profile can also be increased. These measures increase the rigidity and thus the lightweight construction, since reduced wall thickness of the material can be implemented.

Furthermore, a lifting unit can preferably be arranged on the main body of the track by means of a rod, a plug-in connection or two screw connections. The modular structure of such a track can thus be increased. On the one hand, the lifting unit is formed as a module or a drive module and the track is formed as a further module so that the modules can be interconnected in a simple manner merely by an interface.

In particular, the lifting unit is formed as a half scissor, wherein one end of the bearing arm is supported at a base, and the opposite end of the bearing arm has rollers, which are guided in guides of the track. A strut, which engages at one end with the bearing arm, can be fastened at the opposite end to the main body of the track, preferably by a rod, plug-in connection or assembly connection or at least two screw connections.

The invention and further advantageous embodiments and developments will be described and explained in greater detail hereinafter on the basis of the examples illustrated in the drawings. The features to be inferred from the description and the drawings can be applied in accordance with the invention either individually or together in any combination. In the drawings.

Figure 7A:
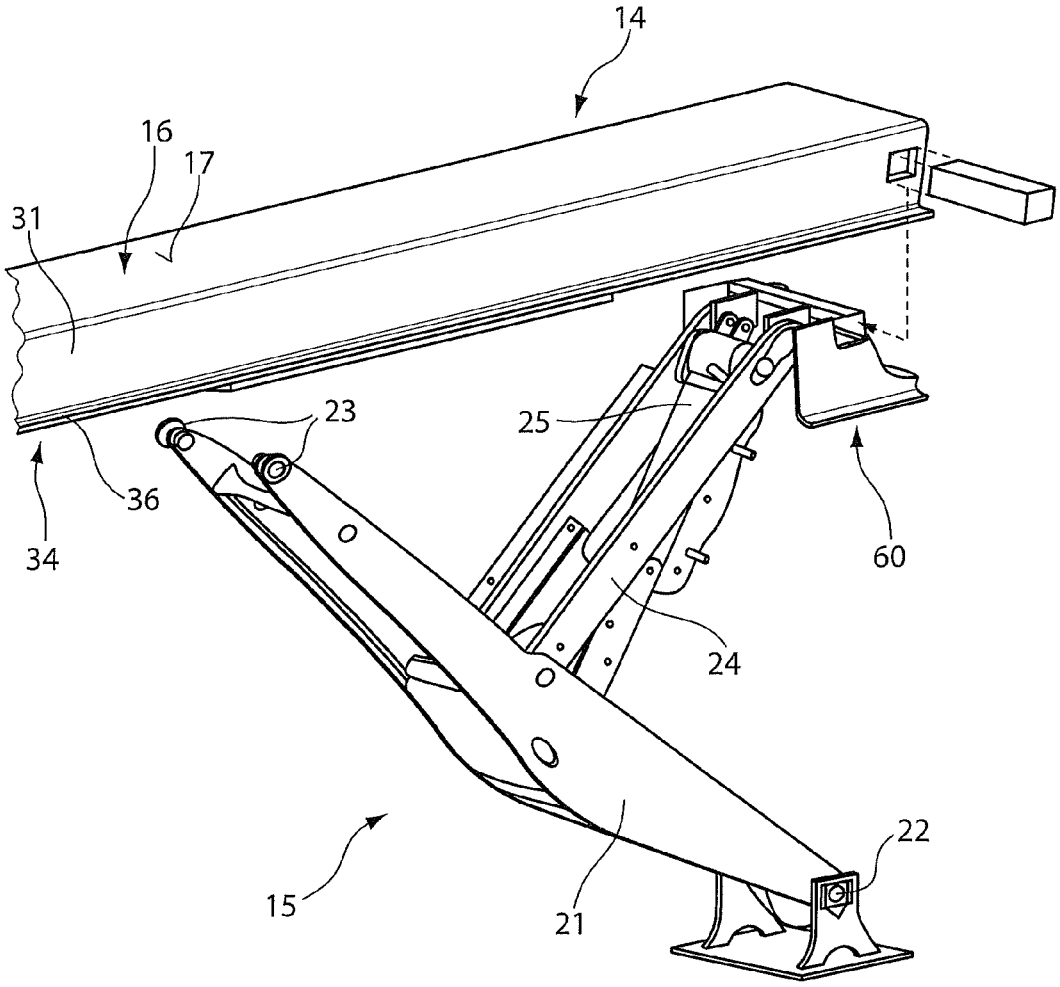
Figure 8:
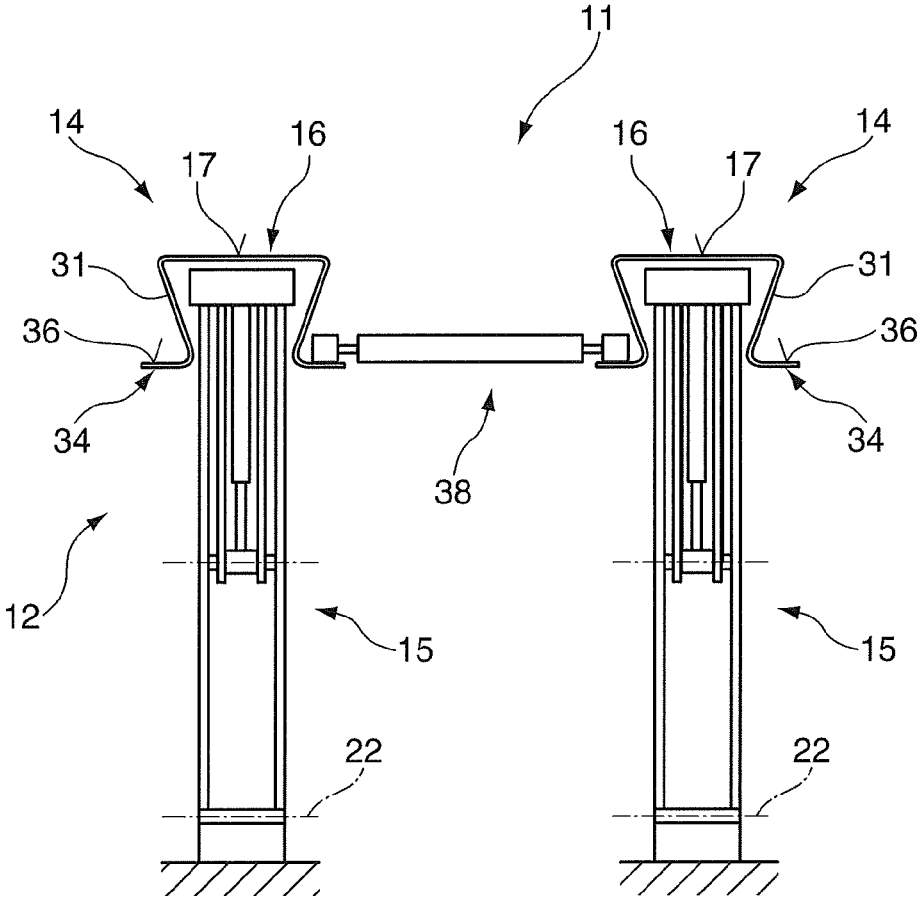

FIGS. 7*a* and *b* show schematic views of the assembly of the lifting unit on the track; and FIG. 8 shows a schematically simplified side view of the track with a jack.

Figure 1:
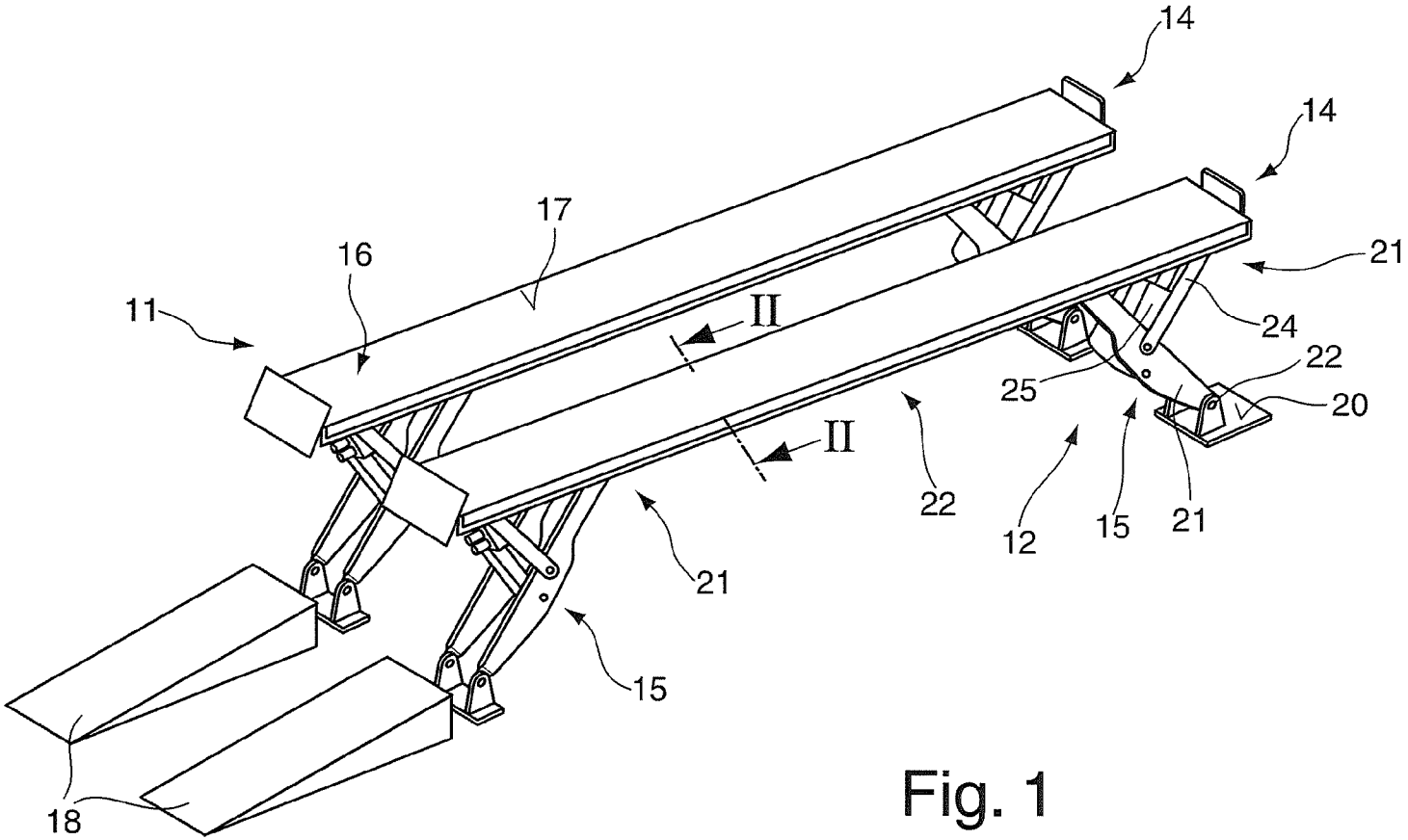
FIG. 1 shows a perspective view of a track lifting device having two tracks in a working position.

FIG. 1 shows a perspective view of track lifting device 11 in a working position 12. The track lifting device consists of two tracks 14 oriented parallel to one another and which, for example, are distanced from one another at a wheel distance of vehicles. In accordance with the exemplary embodiment, the tracks 14 have a front and rear lifting unit 15, which engage with an underside of the track 14. The track 14 comprises a load-bearing support 16 having a running surface 17, so that it is possible to drive onto the track, for example for servicing, repair, and assembly of vehicles, utility vehicles, transport vehicles or the like. To this end, the track lifting device 11 is arranged in an idle position, that is to say that the lifting units 15 are lowered and the tracks 14 are arranged close to the ground or lie on the ground. In such a case, the vehicles can drive onto the tracks 14 via run-up ramps 18. Alternatively, these tracks 14 can be sunk into the ground 20 so that the run-up ramps 18 can be omitted, since the running surface 17 is arranged flush with the ground 20.

Figure 7B:
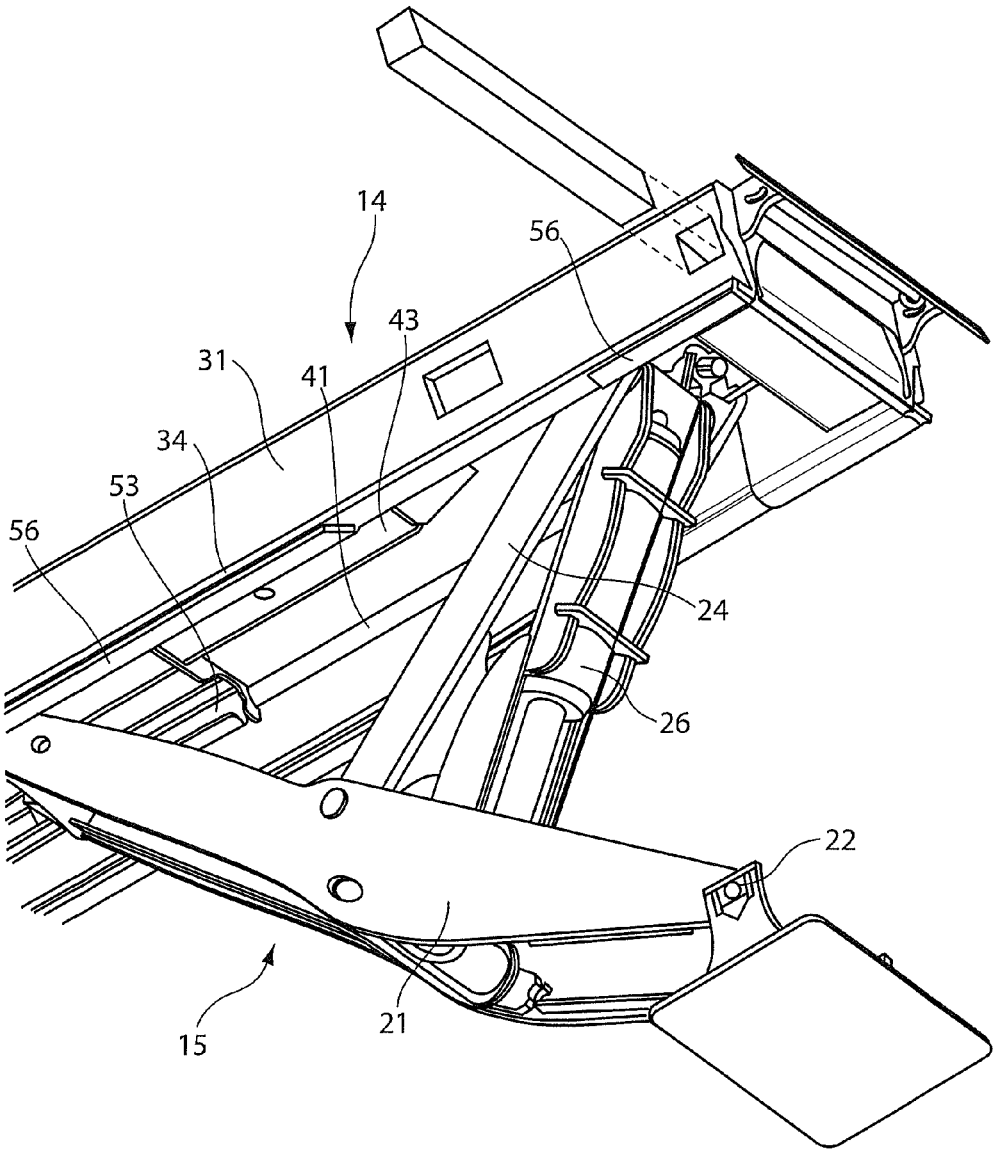

The lifting unit 15 comprises a bearing arm 21, which is arranged via a swivel axis 22 so as to be pivotable relative to the ground 20. Opposite, the bearing arm, comprises rollers 23 (FIG. 7*a*), which are guided inside the track 14. A strut 24 engages with the bearing arm 21 and is likewise fastened inside the track 14 (FIGS. 7*a* and 7*b*). The up and down movement of the lifting unit 15 is controlled by a lifting cylinder 25.

Alternatively to the illustrated half scissor, further lifting elements may be provided, such as parallelogram elements, full scissors, double scissors or the like. The half scissor according to FIG. 1 may also be arranged in a mirror-inverted manner and rotated through 180°.

Figure 2:
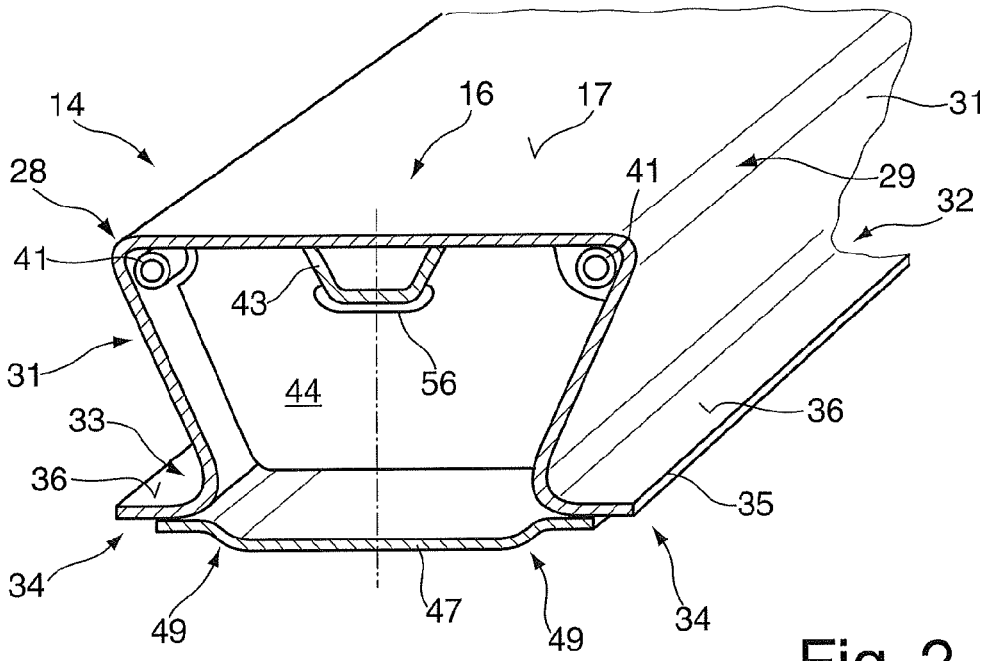
FIG. 2 shows a schematic sectional view along the line II-II in FIG. 1.

FIG. 2 shows a sectional view along the line II-II in FIG. 1. A first embodiment according to the invention of the track 14 can be seen in this sectional illustration. The track 14 consists of a main body 27, which according to a first alternative is produced from a flat plate-like material, in particular a metal sheet. This flat, plate-like material is transferred by four chamfering steps into a shape forming the main body, said shape being omega-like or clamp-like, as shown in FIG. 2. The running surface 17 of the load-bearing support 16 is preferably defined in width by a chamfer 28, 29, whereby a transition to a respective side flank 31 is created. The side flank 31 is in turn defined in height in each case by a further chamfer 32, 33. A receiving flange 34 with its free end 35 oriented towards the outer face of the track 40 is formed by the chamfer 32, 33. A running surface 36 is formed on an upper face of the receiving flange 34 and is formed with an adjoining running surface 36 of a track 14 so as to support a jack 38 (FIG. 8).

This main body 27 of the track 14 is thus formed in one piece. The provided material width of the metal sheet blank preferably consists of a running surface 17, side flanks 31 and receiving flanges 34 as well as chamfers 28, 29, 32 and 33 arranged therebetween or is cut to this width before the chamfering steps are begun. The length of the plate-like material is preferably dependent on the length of the running rail. Plate-like materials with a length of more than 3 m, in particular more than 6 m, are provided so that, where possible, the track 14 can be produced with a plate-like material in accordance with the basic shape illustrated. If longer tracks 14 are required, two or more track portions having a one-piece main body, which comprises the load-bearing support 16, the side flanks 31 and the receiving flanges 34, can also be interconnected or welded together.

The angle of chamfers in the main body 27 of the track 14 according to FIG. 2 between the load-bearing support 16 and the side flanks 31 are preferably the same size as the angle of chamfers between the side flanks 31 and the receiving flanges 34. The angles of chamfer lie preferably in an angular range between 70° and 80°.

Sleeves 41 are preferably provided in an inner side of the chamfer 28, 29 and are used to guide supply lines, in particular hydraulic lines and/or cable guides, so that one lifting unit 15 is supplied via the feed of the supply lines of the other lifting unit 15 in the track, and only a single feed of the supply lines from the ground 20 to the track 14 is required.

A longitudinal stiffening element 43 is provided on an underside of the load-bearing support 16. This stiffening element is preferably formed as a trapezoid longitudinal beam, which is welded onto the underside of the load-bearing support 16. Said beam extends at least in the region between the lifting units 15 and at least in part into the working region of the lifting units 15. For further stiffening of the track 14, transverse stiffening elements 44 are provided which are welded both to an inner side of the side flanks 31 and to the underside of the running surface 16. In addition, these transverse stiffening elements 44 also support the longitudinal stiffening elements 43, at least in part, wherein a cutout 45 is provided to prevent redundancy and crack formation.

Figure 3:
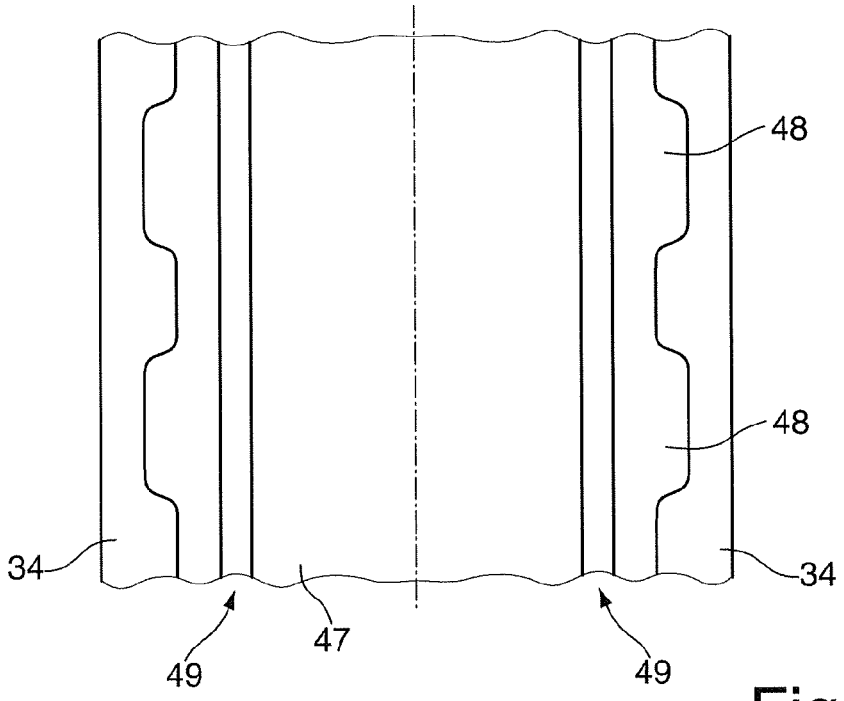
FIG. 3 shows a partial view from below of the track portion according to FIG. 2.

A cover 47 is provided on an underside of the receiving flanges 34 and is welded, at least over portions, to the receiving flanges 34. The cover preferably has a comb-like or meandering side edge in the region of contact with the receiving flange 34, wherein a welded connection to the receiving flanges 34 is preferably provided at the outer longitudinal edges of the surface portions 48. The track 14 can thus also be stiffened for the use of a jack. The cover 47 according to FIGS. 2 and 3 preferably has a chamfer 49, thus increasing rigidity. Alternatively, a flat sheet metal may also be provided.

Before the chamfering steps are carried out to produce the end shape of the main body 27, the plate-like material can be machined, in particular by a cutting jet machining method. Assembly openings can be introduced, for example for the attachment of an electrical junction box, or assembly bores can be introduced, for example to attach sockets to the side flanks 31 for an illumination member.

Furthermore, bores or assembly openings can be introduced to assemble the lifting unit 15 on the main body 27. If necessary, C-shaped profiles 51 for guiding the rollers 23 of the bearing arm 16 can also be fastened on the main body 27 by a screw connection.

Figure 4:
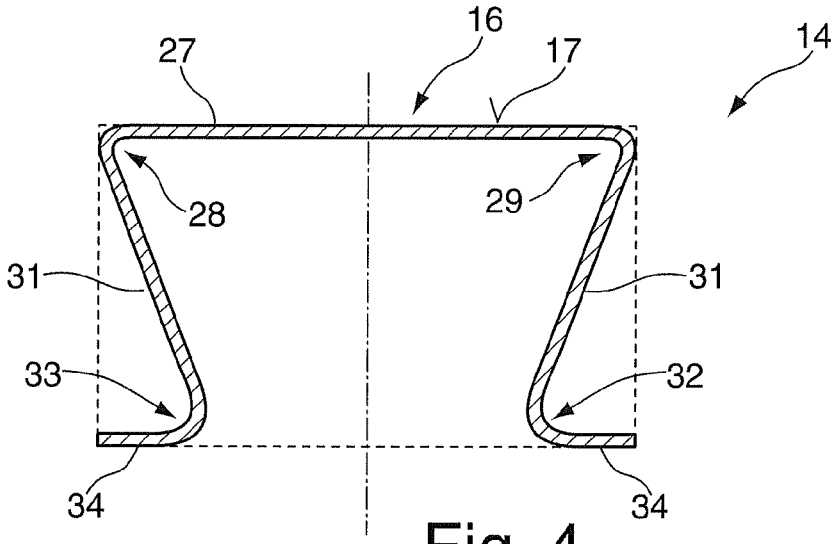
FIG. 4 shows a front view of the main body of the track according to FIG. 2.

FIG. 4 shows a schematic front view of the main body 27 of the track 14 according to FIG. 2 without further additional components. This omega-like shape of the main body 27 has the advantage that such a track 14 has a maximum running surface width and the free ends 35 of the receiving flanges 34 do not protrude beyond the width of the running surface 17 with the adjoining chamfers 28, 29, and it is therefore possible, at the same time, to guide a jack 38. If the width of the running surface 17 can be selected to be smaller, or the overall width of the track 14 can be greater, this means that the receiving flanges 34 may also protrude widthwise beyond the running surface 17, and a greater angle, which may also include 90°, can be selected between the running surface 19 and the side flank 31 and consequently also between the side flank 31 and the receiving flange 34.

When producing a track 14 having a main body 27, as illustrated in FIG. 4 for example, the width of the running surface 17 is generally the dimension having the highest priority in terms of accuracy. This means that, in this embodiment, the chamfers 32, 33 are made first for example, so as to chamfer the receiving flanges 34 relative to the side flanks 31. Lastly, the chamfers 28, 29 are made so as to achieve the greatest possible dimensional accuracy for the width of the running surface 17.

Figure 5:
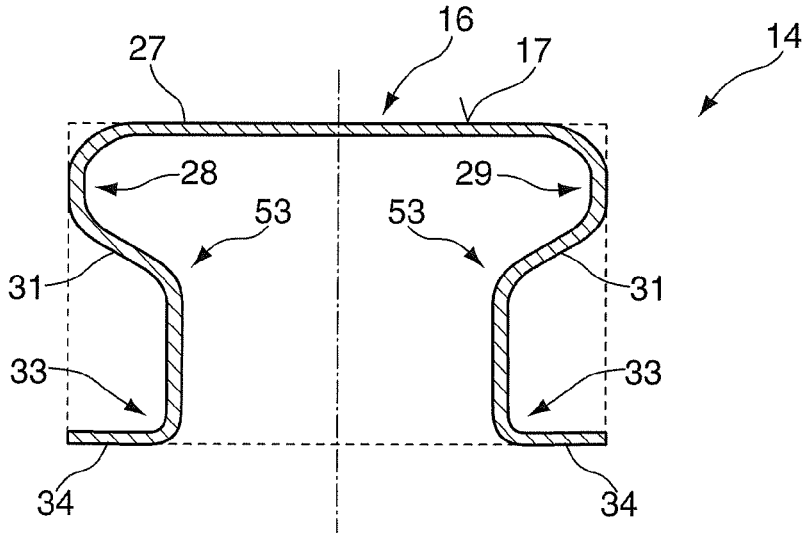
FIG. 5 shows an alternative embodiment to FIG. 4.

An alternative embodiment to FIG. 4 is illustrated in FIG. 5. In this embodiment, at least one further chamfer 53 is provided, for example so as to allow a sufficient clearance for the rollers of the jack 38 in the case of tracks of low height.

Figure 6:
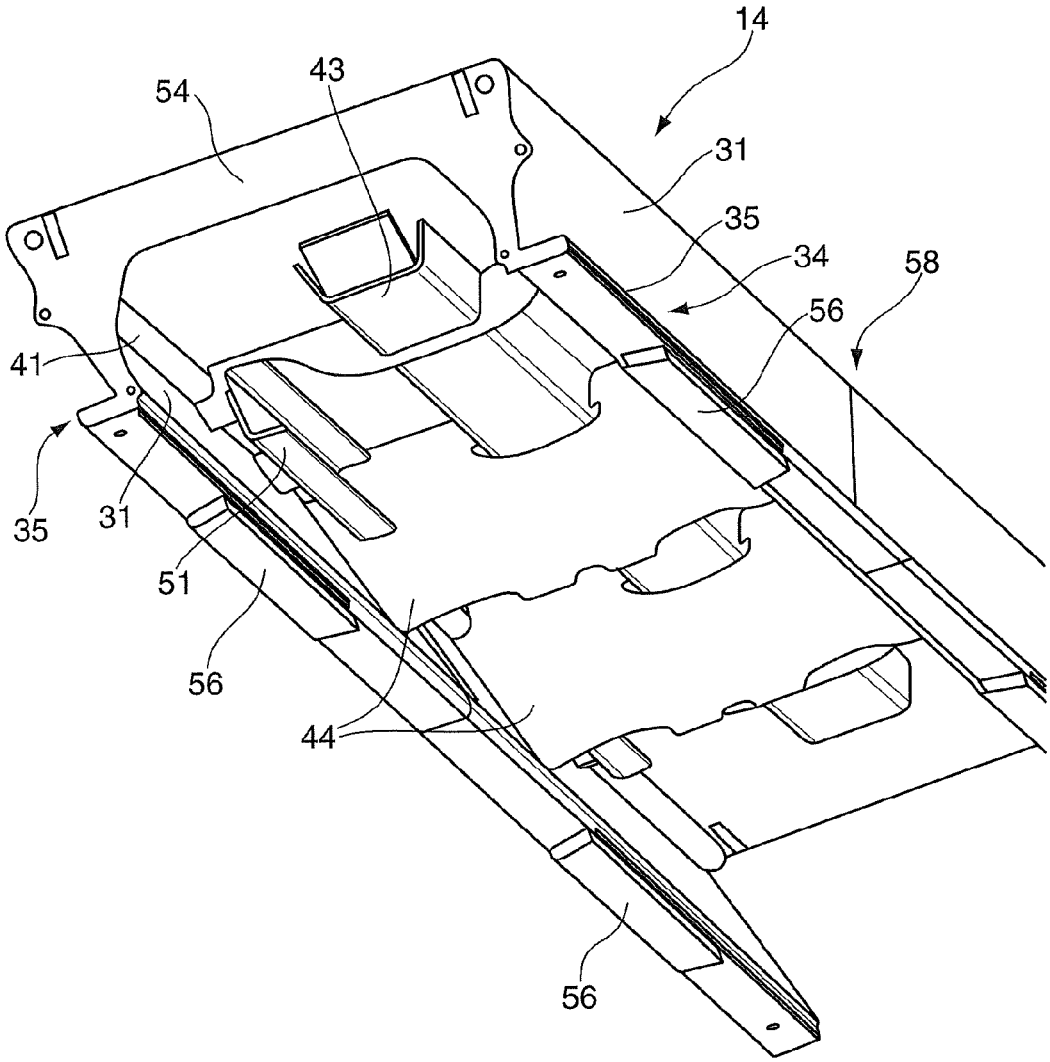
FIG. 6 shows a perspective view from below of the track in the receiving region of a lifting unit.

FIG. 6 shows a schematic view from below of the track 14 according to FIG. 1 in the receiving region of the lifting unit 15, wherein the cover sheet metal 47 is not illustrated. C-profiles 51 are fastened to an underside of the load-bearing support 16 and are used to receive the rollers 23 of the lifting unit 15. Further stiffening means are no longer provided between an end plate 54 and the start of the C-shaped profile 51, since a corresponding clearance for the lifting cylinder 25 arranged between the struts 24 is necessary. Additional stiffening elements 56 are therefore attached on an underside of the receiving flanges 34 to increase rigidity. The load-bearing capacity of the receiving flanges 34, which act as tension flanges during deflection, is thus increased.

In the embodiment in FIG. 6, two tracks 14 for example are interconnected by a welded connection 58. In particular, very long tracks 14 in particular can thus be formed. In addition, relatively short material lengths can also be machined, which are then interconnected by such a welded connection, wherein the continuous cross-sectional shape of the main body 27 formed from a plate-like material is maintained.

FIGS. 7*a* and 7*b* show perspective views of the track 14 and of the lifting unit 15. The two modules (the track 14 and the lifting unit 15) are provided for assembly in accordance with FIG. 7*a*. An assembly device 60 is provided at the upper end of the strut 24 and, for example, can be fastened to the track 14 by a socket pin or by two screw connections. Opposite, the rollers 23 are merely inserted into the C-profiles 51. Rapid and simple assembly and disassembly are thus enabled. This modular structure also allows simple adaptation to different requirements.

FIG. 8 shows a schematic front view of a track lifting device 11 according to FIG. 1. In this view, the jack 38 is also illustrated and can be moved along the travel surface 36 of the receiving flanges 34.

If the running surface 17 of the load-bearing support 16 has to meet specific requirements, an anti-slip coating or an anti-slip covering can be applied to the load-bearing support 16 as a running surface 17.

The invention claimed is:

1. A method for producing a track for a track lifting device, said track being transferrable by at least one lifting unit from an idle position into a working position, in which a main body of the track is formed from a plate-like material, wherein the main body is transferred into an end shape by a plurality of chamfering steps of the plate-like material, in which a chamfer, in each case having a chamfer direction pointing towards the respective other chamfer, is formed between a load-bearing support and each side flank adjoining said load-bearing support laterally, and each side flank thus formed is defined by at least one further chamfer having a chamfer direction opposed to the chamfer direction of the chamfers, and a receiving flange having a travel surface oriented towards a running surface of the load-bearing support is formed.

2. The method according to claim 1, wherein the main body is produced from a flat plate-like material formed as a metal sheet by at least one fourfold chamfering process.

3. The method according to claim 1, wherein the side flanks are chamfered relative to the running surface of the load-bearing support, and the receiving flange is chamfered relative to the side flank, in each case at an angle between 60° and 90°.

4. The method according to claim 1, wherein the chamfers which each have a chamfer direction pointing towards the other chamfer, and together determine the width of the track or the width of the running surface of the track, is made as a last chamfering step.

5. The method according to claim 1, wherein fixing openings, recesses or assembly openings are introduced into the main body by cutting jet machining, either before or between individual chamfering steps.

6. A track, on which at least one lifting unit is arrangable, said track having a load-bearing support which has a running surface, in each case with a side flank which is allocated to the load-bearing support and has a receiving flange with a travel surface at the opposite end to the load-bearing support, and the load-bearing support, the side flanks and the receiving flanges are produced in one piece from a main body made of a plate-like material, a chamfer direction between the load-bearing support and the side flanks being opposed to a chamfer direction between the side flanks and the receiving flange, and wherein outer ends of the receiving flanges point outwardly and are distanced from one another, once chamfers have been made b distance that corresponds to or is less than the width of the running surface.

7. The track according to claim 6, wherein an angle of chamfer of less than 90°, is provided between the load-bearing support and the side flank.

8. The track according to claim 6, wherein an angle of 90° or less is provided between the side flank and the receiving flange, the at least one receiving flange being oriented towards the outer face of the track.

9. The track according to claim 6, wherein at least one longitudinal stiffening element, is arranged on an underside of the load-bearing support.

10. The track according to claim 6, wherein one or more transverse stiffening elements is/are provided, which are supported against the side flanks and the underside of the load-bearing support and engage with a longitudinal stiffening element, at least over portions.

11. The track according to claim 6, wherein a cover is fastened to an underside of the two opposed receiving flanges and extends in the longitudinal direction of the track, at least over portions.

12. The track according to claim 11, wherein the cover is flat or profiled by at least one chamfer.

13. A combination comprising a lifting unit and the track according to claim 6, wherein the lifting unit is assembled on a main body of the track by a rod, a plug-in connection or at least two screw connections.

14. The combination according to claim 13, wherein the lifting unit is formed as a half scissor having a bearing arm and at least one strut arranged thereon, which is movable up and down by a lifting cylinder.

* * * * *